US008215988B2

(12) United States Patent
Ooki et al.

(10) Patent No.: US 8,215,988 B2
(45) Date of Patent: Jul. 10, 2012

(54) WATERPROOF ELECTRICAL CONNECTOR

(75) Inventors: Yuusaku Ooki, Makinohara (JP); Nobuyuki Sakamoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 152 days.

(21) Appl. No.: 12/364,832

(22) Filed: Feb. 3, 2009

(65) Prior Publication Data

US 2009/0197450 A1 Aug. 6, 2009

(30) Foreign Application Priority Data

Feb. 6, 2008 (JP) ..... 2008-026009

(51) Int. Cl.
*H01R 13/40* (2006.01)

(52) U.S. Cl. ..... 439/599

(58) Field of Classification Search ..... 439/271, 439/275, 587–589, 598, 599, 752
See application file for complete search history.

(56) References Cited

U.S. PATENT DOCUMENTS

| | | | | |
|---|---|---|---|---|
| 4,707,045 | A * | 11/1987 | Ney et al. | 439/588 |
| 6,203,348 | B1 | 3/2001 | Fukuda | |
| 6,343,952 | B1 * | 2/2002 | Fukuda | 439/587 |
| 6,494,731 | B1 * | 12/2002 | Suzuki | 439/275 |
| 6,786,768 | B2 * | 9/2004 | Murakami | 439/595 |
| 6,840,804 | B2 * | 1/2005 | Murakami et al. | 439/587 |
| 7,326,080 | B2 * | 2/2008 | Sakamoto et al. | 439/587 |
| 7,381,090 | B2 * | 6/2008 | Sakamoto et al. | 439/587 |
| 7,419,396 | B2 * | 9/2008 | Sakamoto et al. | 439/271 |
| 7,507,118 | B2 * | 3/2009 | Azuma et al. | 439/587 |
| 7,722,396 | B2 * | 5/2010 | Suzuki et al. | 439/587 |
| 2002/0052141 | A1 | 5/2002 | Hattori et al. | |
| 2006/0240710 | A1 * | 10/2006 | Kato et al. | 439/587 |
| 2007/0254513 | A1 | 11/2007 | Azuma et al. | |
| 2009/0042442 | A1 * | 2/2009 | Sakamoto et al. | 439/587 |
| 2010/0136842 | A1 * | 6/2010 | Sakamoto et al. | 439/639 |

FOREIGN PATENT DOCUMENTS

| | | | |
|---|---|---|---|
| JP | 05-152028 | A | 6/1993 |
| JP | 2000323227 | A | 11/2000 |
| JP | 2002-203615 | A | 7/2002 |

OTHER PUBLICATIONS

Republic of China Office Action for 200910005738.6 dated Dec. 27, 2010 with English translation.
Chinese OA 20091005738.6 dated Jun. 29, 2011 with English translation.

* cited by examiner

*Primary Examiner* — Vanessa Girardi
(74) *Attorney, Agent, or Firm* — Sughrue Mion, PLLC

(57) ABSTRACT

The present invention provides a connector having a seal member for sealing around an electrical wire. The connector includes a connector housing, the seal member, and a rear holder. The connector housing has a layer-by-layer arrangement of plate-shaped housings which each have terminal receiving channels to receive terminals. The seal member has a seal main body surrounding the electrical wire and a tube portion projecting from the seal main body in the lengthwise direction of the electrical wire. The rear holder includes a plurality of holders to pinch the tube portion of the seal member. Each holder has a groove to pinch the tube portion of the seal member and the groove compresses an inner diameter of the tube portion when the holders pinch the tube portions therebetween.

6 Claims, 4 Drawing Sheets

WATERPROOF ELECTRICAL CONNECTOR

BACKGROUND OF THE INVENTION

1. Field of the Invention

The present invention relates to a connector having a watertight configuration with respect to a gap between the connector and an electrical wire.

2. Description of the Related Art

A motor vehicle is mounted with a variety of electrical devices. Electrical power or control signal is supplied to the electrical devices via a wiring harness. The wiring harness includes a plurality of the electrical wires and a connector. The electrical wire has a conductive core wire and an insulation covering the core wire.

There are several sealed connectors to prevent entry of liquid such as water into the connector. For example, (JP) H05-152028 A discloses a connector having a connector housing and a seal member. The connector housing includes a box-shaped first housing having a terminal-receiving channel to receive a terminal connected with an electrical wire and a tube-shaped second housing receiving the first housing therein.

The seal member has a plate shape and is formed from a resilient material such as rubber. The seal member has a plurality of through-holes to allow entry of the electrical wires connected with the terminals. The seal member is press-fitted in the second housing receiving the first housing and seals the connector.

The connector is assembled in the following way. The electrical wires are passed through the through-holes of the seal member and the terminals are attached to end portions of the electrical wires. The terminals are inserted into terminal-receiving chambers of the first housing and the first housing is received in the second housing. The seal member is then press-fitted into the second housing and the connector is mated to a mating connector.

The seal member seals around the electrical wires and prevents entry of liquid such as water into the terminal-receiving chamber of the first housing.

The connector of (JP) H05-152028 A has the plurality of the through-holes accepting entry of the electrical wires.

Accordingly, when the electrical wires are stretched or bent, the seal member resiliently deforms and causes gaps against the electrical wires, resulting in entry of liquid such as water through the gaps.

The seal member can be more press-fitted into the second housing to seal around the electrical wires. However, a large press-fitting force is required to press-fit the seal member against the resilient force of the seal member, resulting in low efficiency of assembly of the connector.

SUMMARY OF THE INVENTION

An object of the present invention is to provide a connector having a seal member for sealing around an electrical wire against water.

According to a first aspect of the present invention, a connector includes a connector housing for receiving a terminal; a seal member made of a resilient material and attached to the connector housing for sealing around an electrical wire attached to the terminal; and a rear holder made of a synthetic resin and attachable to the seal member, wherein the seal member includes a seal main body attachable to the connector housing and a tube portion projecting outwardly from the seal main body in a longitudinal direction of the electrical wire and covering the electrical wire, and the rear holder has a plurality of holders for pinching the tube portion therebetween, the plurality of the holders having a compression portion for compressing the tube portion and decreasing an inner diameter of the tube portion when the holders pinch the tube portion.

Thereby, the tube portion of the seal member assuredly seals around the electrical wire. The holders pinching the tube portion suppress elastic deformation of the tube portion and prevent occurrence of a gap between the electrical wire and the tube portion.

Preferably, end portions of the holders are rotatably connected with a resiliently deformable link portion and end portions of the holders are engageable together with lock portions.

Thereby, the holders pinching the tube portion of the seal member are easily fitted together.

DETAILED DESCRIPTION OF THE PREFERRED EMBODIMENTS

Figure 1:
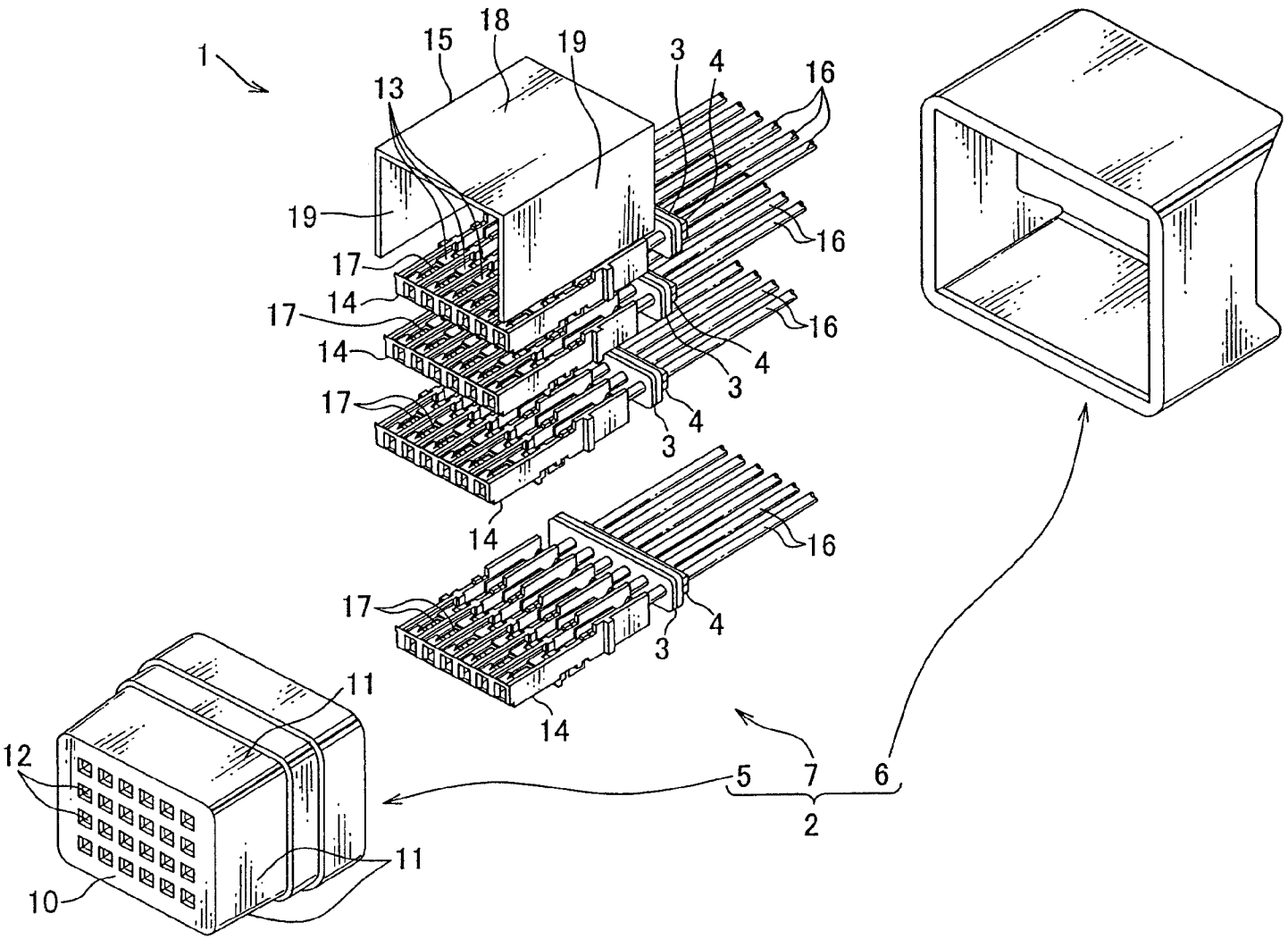
FIG. 1 is an exploded perspective view of a first embodiment of a connector of the present invention.

An embodiment of a connector of the present invention is explained by referring to FIGS. 1-7. Referring to FIG. 1, the connector 1 includes a connector housing 2, seal members 3, and rear holders 4. The connector housing 2 includes a housing main body 5, an outer case 6, and a connector block 7.

The housing main body is formed from an insulation synthetic resin. The housing main body 5 is tube-shaped, and includes a facing wall 10 having a plurality of holes 12 to allow entry of male tubs of a mating connector and a plurality of peripheral walls 11 extending from an outer edge of the facing wall 10. The housing main body 5 receives the connector block 7.

The outer case 6 is made of an insulation synthetic resin and tube-shaped. The housing main body 5 receiving the connector block 7 is fitted into the outer case 6.

Figure 2:
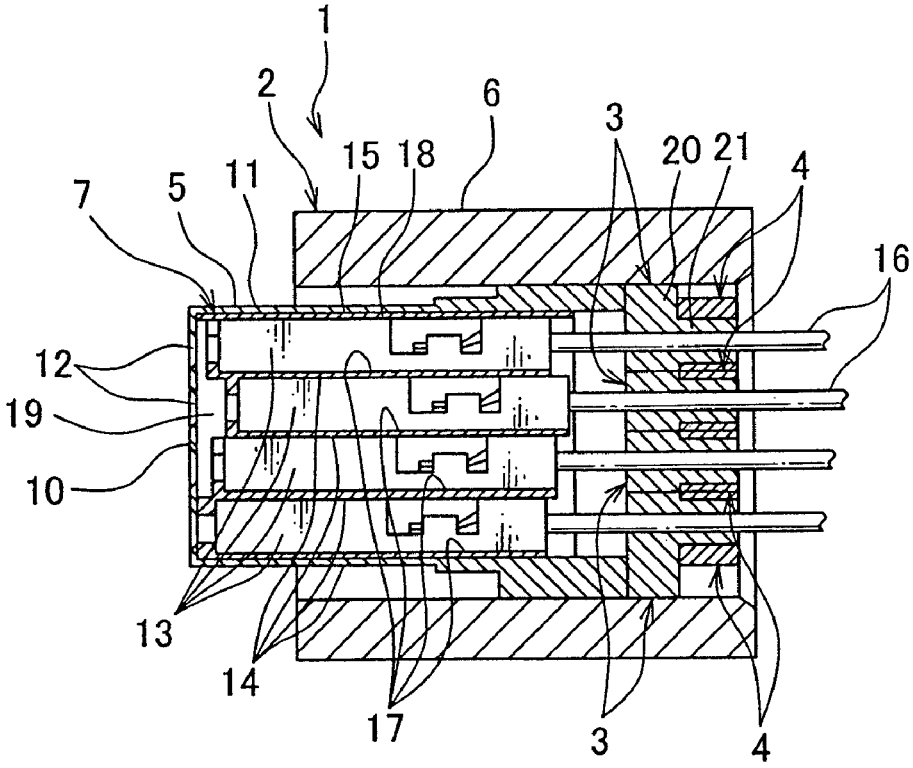
FIG. 2 is a cross-sectional view of the connector of FIG. 1.

Referring to FIGS. 1 and 2, the connector block 7 includes a plurality of female terminals 13, a plurality of plate-shaped housings 14, and a cover 15.

The female terminals 13 are formed from a conductive metal plate, and each of them includes an electrical wire connection portion and an electrical contact portion. The electrical wire connection portions are each connected to an end portion of an electrical wire 16. The electrical contact portions are each tube-shaped and receive a male tab of a mating male terminal to achieve electrical connection with the male terminal.

The embodiment shows that the connector block 7 has four of the plate-shaped housings 14 made of an insulation synthetic resin. Each plate-shaped housing 14 has a plurality of terminal receiving channels 17, which are disposed parallel to one another, to receive the female terminals 13, and the plate-shaped housings 14 are then superposed one another.

The cover 15 has a U-shape and is made of an insulation synthetic resin. The cover 15 has an upper wall 18 and opposite side walls 19 extending downwardly from edges of the upper wall 18. The upper wall 18 of the cover 15 covers the uppermost plate-shaped housing 14, and the opposite side walls 19 hold the plate-shaped housings 14 therebetween.

The connector block 7 is assembled in a way that the plate-shaped housings 14 having the terminal receiving channels 17 receiving the female terminals 13 connected with the electrical wires 16 are superposed one another, and covered and held with the cover 15.

Figure 3:
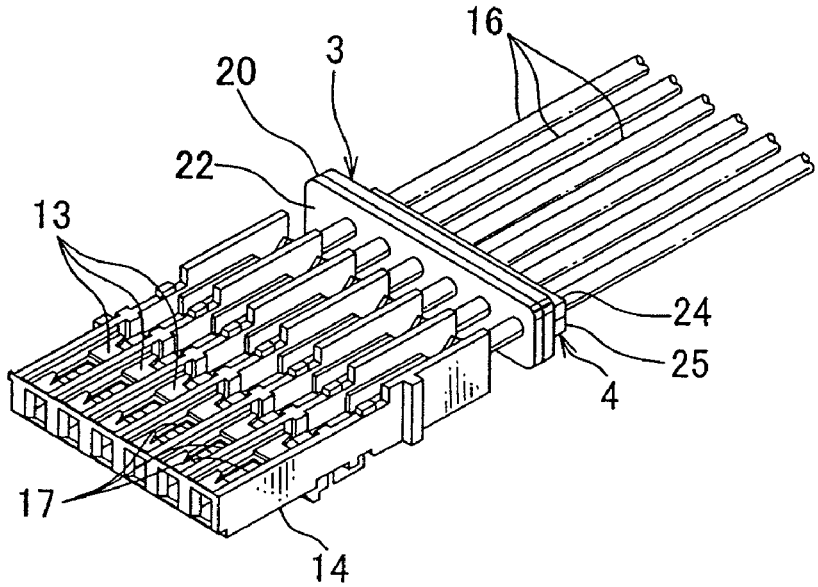
FIG. 3 is a perspective view of a part of a connector block of the connector of FIG. 1.
Figure 4:
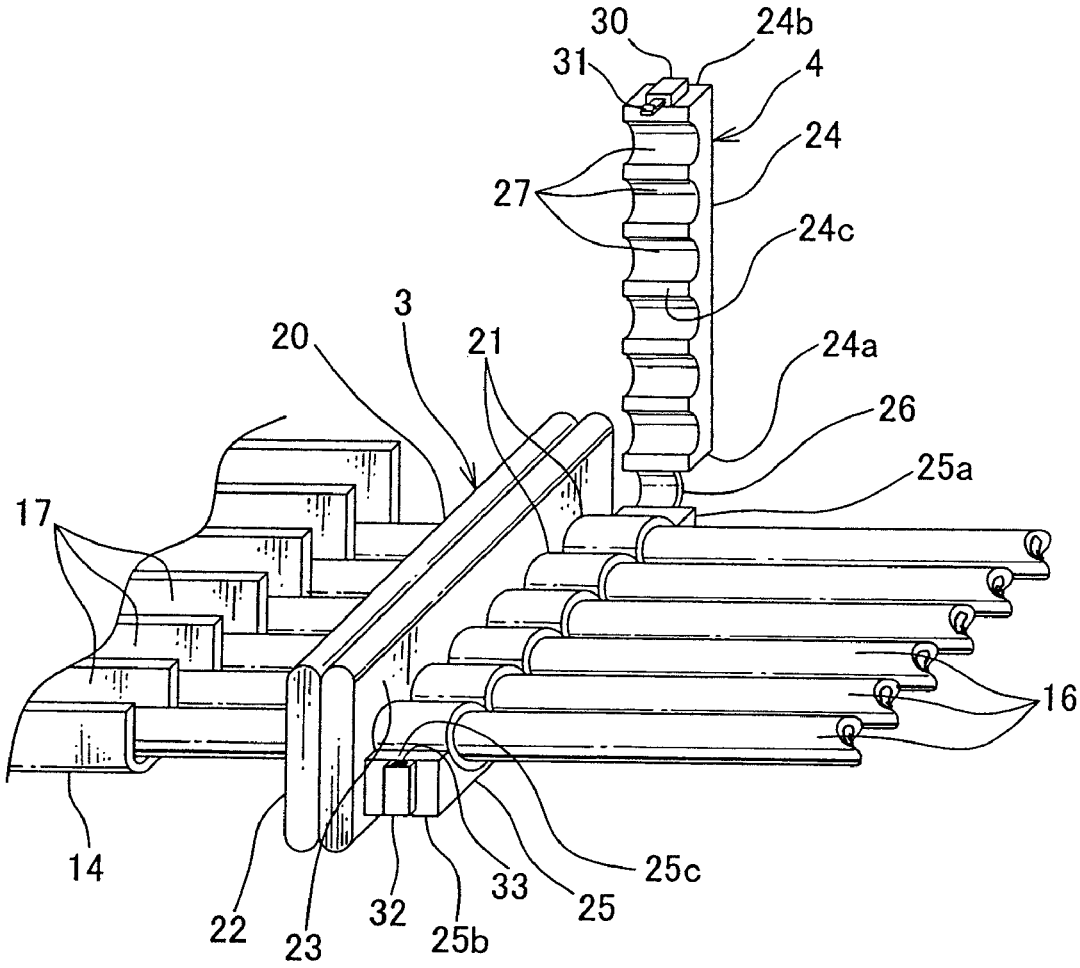
FIG. 4 is a perspective view showing that a rear holder of FIG. 3 is not assembled yet to a seal member.

The seal members 3 made from a resilient material such as rubber are each disposed on the respective plate-shaped housings 14 as shown in FIG. 1. Each seal member 3 is mold-formed to cover the electrical wires 16 connected with the female terminals 13, and includes a seal main body 20 and tube portions 21 as shown in FIGS. 2-4.

Each of the seal main bodies 20 is plate-shaped and one face 22 thereof abuts on an end portion of the housing main body 5 when the female terminals 13 are received in the terminal receiving channels 17. The tube portions 21 of each seal member 3 project from another face 23 of the seal main body 20 in a longitudinal direction of the electrical wires 16 and cover the electrical wires 16.

Figure 5:
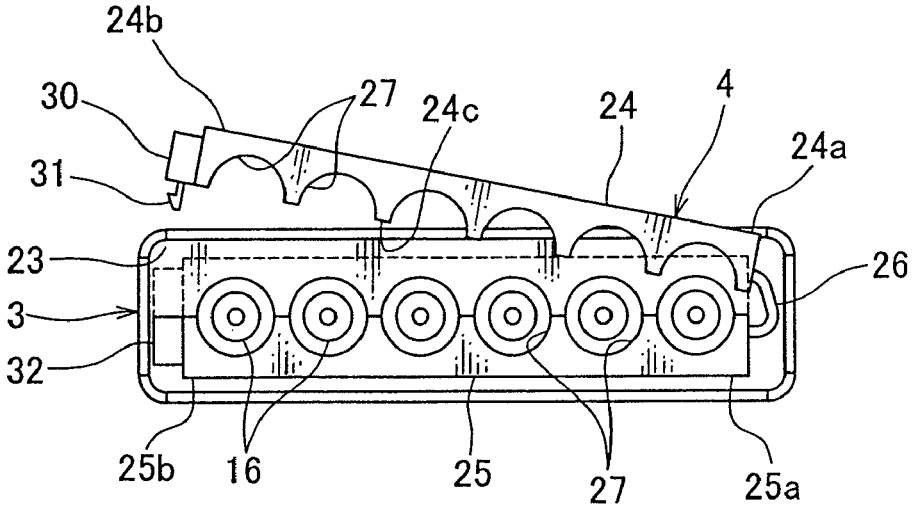
FIG. 5 is a front view of the rear holder of FIG. 3.

Each seal member 3 is utilized with the associated rear holder 4, which is made of a hard insulation synthetic resin, hardly resiliently deformed, as shown in FIG. 1. Referring to FIGS. 4 and 5, the rear holder 4 has a pair of holders 24 (a first holder) and 25 (a second holder) to hold the tube portions 21 of the seal member 3 therebetween and a link portion 26 to link proximal end portions 24*a* and 25*a* of the respective holders 24 and 25.

The pair of the holders 24 and 25 is rod-shaped and has a plurality of grooves 27 on opposite faces 24*c* and 25*c* in order to pinch the tube portions 21 when the first and the second holder 24 and 25 are superposed parallel to one another.

The plurality of the grooves 27 have a circular arc cross-section. The grooves 27 are disposed parallel to one another in the lengthwise direction of the first and the second holder 24 and 25, and extend in the longitudinal direction of the electrical wires 16. The grooves 27 thus correspond to a compression portion.

The link portion 26 is band-shaped and interconnects the proximal end portion 24*a* of the holder 24 and the proximal end portion 25*a* of the holder 25 so that the holders 24 and 25 are rotatable with respect to the link portion 26.

The first holder 24 has a lock projection 30 at a distal end portion 24*b* thereof. The lock projection 30 has a hook 31 projecting toward the second holder 25. When the distal end portions 24*b*, 25*b* of the holders 24, 25 are abutted to one another, the lock projection 30 enters into a lock hole 33 and engages a catcher 32 of the second holder 25. The lock projection 30 thus corresponds to a first lock portion.

The second holder 25 has the catcher 32 at the distal end portion 25*b* to accept the hook 31 of the first holder 24. The catcher 32 thus corresponds to a second lock portion.

The connector 1 is assembled in a way that the seal members 3 and the rear holders 4 are attached to the assembled connector block 7. The seal members 3 are mold-formed to cover around the electrical wires 16 connected to the female terminals 13.

The rear holders 4 are each attached to the associated seal member 3 mold-formed around the electrical wires 16. The tube portions 21 of the seal member 3 are positioned in the grooves 27 of the second holder 25 of the rear holder 4, as shown in FIG. 4. The first holder 24 is then rotated toward the second holder 24 about the link portion 26 so that the pair of the holders 24 and 25 pinches the tube portions 21 with the grooves 27 and the opposite faces 24*c* and 25*c* come into contact one another, as shown in FIG. 5.

The hook 31 of the first holder 24 engages the catcher 32 of the second holder 25 so that the grooves 27 of the first and the second holder 24, 25 compress the tube portions 21 therebetween and decrease inner diameters of the tube portions 21.

The female terminals 13 connected to the electrical wires 16 sealed with the seal member 3 and the rear holder 4 are then attached to the associated plate-shaped housing 14. The plate-shaped housings 14 are force-pressed together and the cover 15 is mounted to the assembled housings 14.

The assembled connector block 7 is then inserted into the housing main body 5 and the housing main body 5 is force-inserted into the outer case 6. When the outer case 6 and the housing main body 5 is engaged together, an outer circumferential surface of the seal main body 20 comes in contact with an inner surface of the outer case 6, as shown in FIG. 2, and the seal between the tube portions 21 and the electrical wires 16 is achieved.

The above-described connector 1 is then fitted to the mating terminal and functions as the wiring harness in a motor vehicle.

The pair of the holders 24 and 25 of the rear holder 4 are positioned outside of the seal main body 20 with respect to the female terminals 13 and force-press the tube potions 21 surrounding the electrical wires 16 with the grooves 27 so as to decrease the inner diameters of the tube portions 21.

This configuration ensures sealing between the tube portions 21 of the respective seal members 3 and the associated electrical wires 16. The tube portions 21 are pinched with the pair of the holders 24 and 25, and deformations of the tube portions 21 thus hardly occur. Accordingly, the tube portions 21 suppress occurrence of gaps against the electrical wires 16. The seal members 3 thus seal the gaps against the electrical wires 16 and prevent liquid such as water from entering into the connector 1.

Each pair of the holders 24, 25 are rotatably interconnected with the link portion 26, and the lock projection 30 and the catcher 32 are easily engageable so as to pinch the tube portions 21 of the seal member 3. The holders 24 and 25, i.e. the rear holder 4, are thus easily assembled to the seal member 3.

Figure 6:
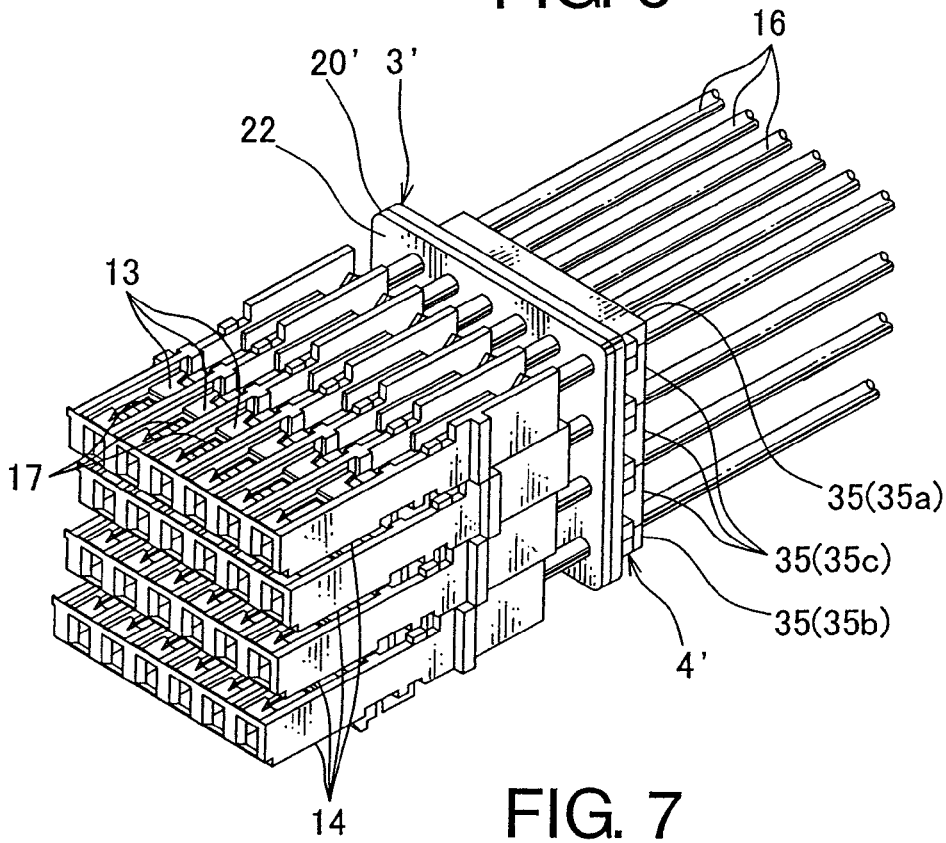
FIG. 6 is a perspective view of a second embodiment of the seal member and the rear holder of FIG. 3.
Figure 7:
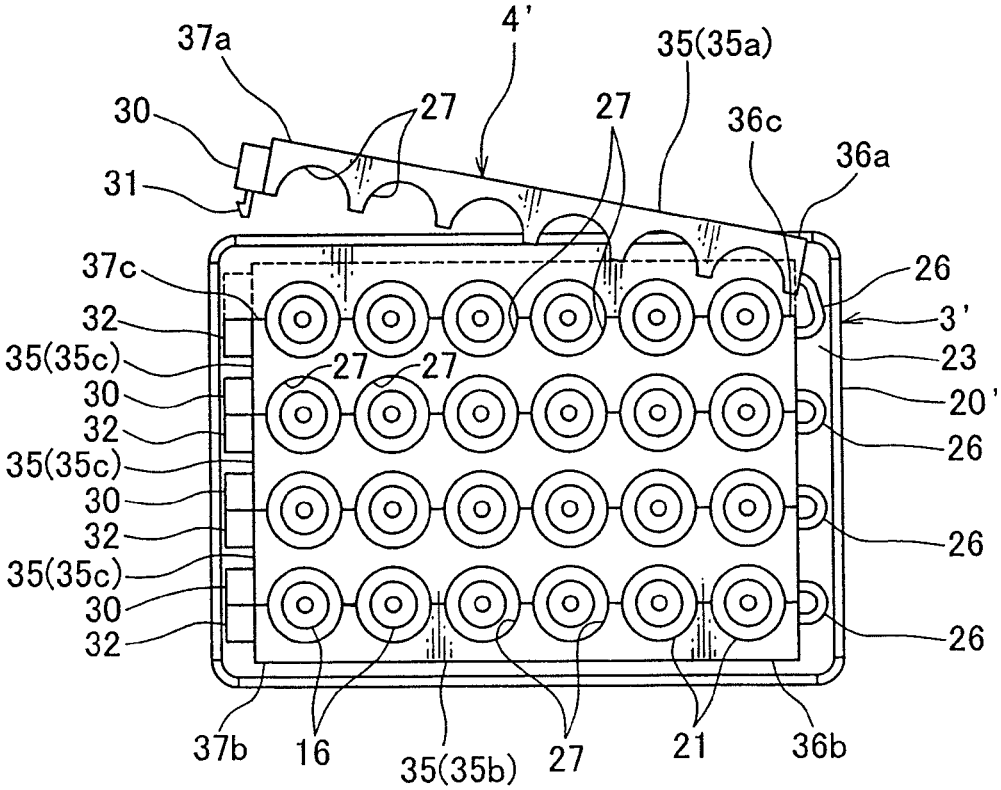
FIG. 7 is a front view of the rear holder of FIG. 6.

Referring to FIGS. 6 and 7, a single seal member 3' and a single rear holder 4' are adapted for the plurality of the plate-shaped housings 14. It is noted that reference signs of FIGS. 6-7 have the same numbers about the same portions as described above.

The single seal member 3' is formed on the electrical wires 16, which are connected to the female terminals 13 received in the connector block 7, i.e. the plurality of the plate-shaped housings 14, and covers around the electrical wires 16.

The single rear holder 4' has a plurality of holders 35, five holders in FIGS. 6 and 7, and is adapted for the connector block 7 having the plurality of the plate-shaped housings 14.

The uppermost holder 35*a* and the lowermost holder 35*b* each have the plurality of the grooves 27 to pinch the electrical wires 16 with an associated adjacent holder 35*c*. The uppermost holder 35*a* has the lock projection 30 at a distal end portion 37*a* thereof and the lowermost holder 35*b* has the catcher 32 at the distal end portion 37*b* thereof.

Each holder 35*c* except the holders 35*a*, 35*b* has the plurality of the grooves 27 on both sides to pinch the electrical wires 16. Each holder 35*c* has the catcher 32 and the lock projection 30 at an upper and a lower portion of a distal end portion 37*c*. The catcher 32 and the lock projection 30 are projecting outwardly from the distal end portion 37*c* in the lengthwise direction of the holder 35*c*.

The holders 35*a*-35*c* are rotatably interconnected with the respective link portions 26 at proximal end portions 36*a*-36*c*.

The holders 35*a*-35*c* are assembled together with engagement between the lock projections 30 and the catchers 32 with the link portions 26 so as to pinch the tube portions 21 of the seal member 3'. The rear holder 41 is thus easily assembled to the seal member 3'.

The embodiments described above are only exemplary and not limited thereto. Any alteration and modification are within the scope of the present invention.

What is claimed is:

1. A connector, comprising:

a connector housing including a connector block;

the connector block comprising:

a plurality of electrical wire seal members made of a resilient material, each seal member comprising a plate shaped face from which tube portions protrude perpendicularly and outwardly in a longitudinal direction;

a plurality of rear holders, made of a synthetic resin, lie adjacent the face of respective seal members;

wherein each of the rear holders comprises a first holder and a second holder hinged together, the first holder and the second holder further comprise a plurality of grooves such that when the first holder and the second holder are brought in opposing relation to one another, the grooves form a compression portion which directly pinch the tube portion therebetween resulting in a decreased inner diameter of the tube portion.

2. The connector as claimed in claim 1, wherein first end portions of the holders are rotatably connected with a resiliently deformable link portion and second end portions of the holders are engageable together with lock portions.

3. The connector as claimed in claim 1, wherein the compression portion of the holders comprises grooves which pinch the tube portions when the holders are brought in the opposing relation to one another.

4. The connector as claimed in claim 1, wherein the holders are made of synthetic resin.

5. The connector as claimed in claim 1, wherein the seal member is mold formed to cover the electrical wire.

6. The connector as claimed in claim 1, wherein the housing receives the terminal at a first side of the seal main body, and the rear holder is disposed at a second side of the seal main body which is opposite to the first side.

* * * * *